US009266139B2

(12) United States Patent
Bruggeman et al.

(10) Patent No.: US 9,266,139 B2
(45) Date of Patent: Feb. 23, 2016

(54) PAINT/STAIN STICK PAD WITH ROLLER/PAD APPLICATOR

(75) Inventors: Daniel Bruggeman, Minneapolis, MN (US); Dion McDevitt, Ramsey, MN (US); Stephen Kohs, Forest Lake, MN (US)

(73) Assignee: Diversified Dynamics Corp., Minneapolis, MN (US)

( * ) Notice: Subject to any disclaimer, the term of this patent is extended or adjusted under 35 U.S.C. 154(b) by 687 days.

(21) Appl. No.: 13/545,645

(22) Filed: Jul. 10, 2012

(65) Prior Publication Data

US 2014/0016986 A1 Jan. 16, 2014

(51) Int. Cl.

| | |
|---|---|
| ***B05C 17/00*** | (2006.01) |
| ***B05C 1/00*** | (2006.01) |
| ***A46B 11/00*** | (2006.01) |
| ***B05C 17/02*** | (2006.01) |
| ***B05C 17/03*** | (2006.01) |

(52) U.S. Cl.

CPC . *B05C 1/00* (2013.01); *B05C 17/00* (2013.01); *B05C 17/002* (2013.01); *B05C 17/0217* (2013.01); *B05C 17/0325* (2013.01)

(58) Field of Classification Search

CPC ..... B05C 1/00; B05C 17/00
USPC ..... 401/138, 6, 9, 198, 140; 15/10, 210
See application file for complete search history.

(56) References Cited

U.S. PATENT DOCUMENTS

| | | | |
|---|---|---|---|
| 2,249,401 | A | 7/1941 | Sieg |
| 2,478,318 | A | 8/1949 | Raub et al. |
| 2,722,029 | A | 11/1955 | Barnes et al. |
| 2,825,916 | A | 3/1958 | Basala, Jr. |
| 2,916,755 | A | 12/1959 | De Bozzay |
| 2,964,769 | A | 12/1960 | Mercereau |
| 3,020,579 | A | 2/1962 | O'Connor |
| 3,103,690 | A | 9/1963 | Day |
| 3,175,242 | A | 3/1965 | Kamondy et al. |
| 3,195,170 | A | 7/1965 | Howard |
| 3,210,794 | A | 10/1965 | Vosbikian |
| 3,231,151 | A | 1/1966 | Clark et al. |
| 3,337,899 | A | 8/1967 | Rentfrow |

(Continued)

FOREIGN PATENT DOCUMENTS

| | | |
|---|---|---|
| EP | 0962259 | 12/1999 |
| GB | 868894 | 5/1961 |

(Continued)

*Primary Examiner* — Mark A. Laurenzi, III
*Assistant Examiner* — Thomas M Abebe
(74) *Attorney, Agent, or Firm* — Gerald E. Helget; Nelson R. Capes; Briggs and Morgan, P.A.

(57) ABSTRACT

A paint/stain stick pad, for use with a paint/stain reservoir handle and dispensing plunger for coating deck boards with opposing side edges having joints therebetween, has a platform having a top and a bottom. The top has a pivotal connection to the handle and a paint/stain inlet in flow communication with the paint/stain in the reservoir handle. The bottom has a paint/stain dispensing and spreading surface in flow communication with the paint/stain inlet for evenly dispensing the paint/stain along the dispensing surface onto the boards. A central cut out is provided in the platform into which a stain/paint applicator is mounted in a floating arrangement within the cut out and biased downwardly as to dispense paint/stain onto the opposing board edges in the joints.

18 Claims, 9 Drawing Sheets

(56) References Cited

U.S. PATENT DOCUMENTS

| | | | | |
|---|---|---|---|---|
| 3,369,268 | A | 2/1968 | Burns et al. | |
| 3,418,054 | A | 12/1968 | Kirch | |
| 3,457,017 | A | 7/1969 | Bastian | |
| 3,459,482 | A | 8/1969 | Fears | |
| 3,554,659 | A | 1/1971 | Stokes | |
| 3,612,707 | A | 10/1971 | Herbrechter et al. | |
| 3,623,179 | A | 11/1971 | Roth | |
| 3,702,739 | A | 11/1972 | Rentfrow | |
| 3,766,879 | A | 10/1973 | Jones | |
| 3,776,645 | A | 12/1973 | Walker | |
| 4,217,062 | A | 8/1980 | Trp et al. | |
| 4,231,668 | A | 11/1980 | Groth et al. | |
| 4,540,301 | A | 9/1985 | Swanson et al. | |
| 4,611,941 | A | 9/1986 | Karliner et al. | |
| 4,639,156 | A | 1/1987 | Stern et al. | |
| 4,695,176 | A | 9/1987 | Simonette et al. | |
| 4,732,503 | A | 3/1988 | Bader et al. | |
| 4,742,597 | A * | 5/1988 | LaFlamme | 15/244.2 |
| 4,810,123 | A | 3/1989 | Bruggeman | |
| 4,822,194 | A | 4/1989 | Simonette | |
| 4,997,302 | A | 3/1991 | Simonette | |
| 5,167,055 | A | 12/1992 | Stoddart et al. | |
| 5,419,646 | A | 5/1995 | Taylor | |
| 5,522,110 | A | 6/1996 | Borofsky | |
| 5,594,971 | A | 1/1997 | Nelson | |
| 5,613,264 | A | 3/1997 | Knowles | |
| 5,997,205 | A | 12/1999 | Koide | |
| 6,059,475 | A | 5/2000 | Jafarmadar | |
| 7,192,210 | B2 * | 3/2007 | Svendsen et al. | 401/9 |
| 7,325,990 | B2 | 2/2008 | Svendsen et al. | |
| 8,210,760 | B2 * | 7/2012 | Sandahl et al. | 401/9 |
| 8,479,348 | B2 * | 7/2013 | DeCarr | 15/210.1 |
| 2001/0025394 | A1 | 10/2001 | Napolitan | |
| 2004/0205921 | A1 | 10/2004 | Woodruff et al. | |

FOREIGN PATENT DOCUMENTS

| | | | |
|---|---|---|---|
| GB | 2148154 | A | 5/1965 |
| GB | 2094443 | A | 2/1982 |
| GB | 2155147 | A | 9/1985 |

* cited by examiner

PAINT/STAIN STICK PAD WITH ROLLER/PAD APPLICATOR

BACKGROUND OF THE INVENTION

The present invention relates to a paint/stain stick with a pad for painting and staining floor-level flat surfaces by an operator while standing upright, and more particularly, to a paint/stain stick pad with a roller/pad applicator for coating cracks between boards.

Referring to FIG. 1, paint/stain sticks 26 for coating decks, docks and other flat surfaces are well known and commonly used as they do not require the operator to kneel or bend over when coating a deck 12. Deck 12 is generally comprised of wooden boards 14 with joints 16 therebetween which either maybe tight 18, small 20 or large 22.

Stain stick 26 is handled by operator 28 while in the standing position. Stick 27 includes plunger 28 which telescopes into reservoir 32 which has an uptake port 34. At the end of the reservoir 32 is a swivel or gimbal joint 36 to which is connected the paint or stain pad 38. The reservoir 32 and the pad 38 are in flow communication. Stain pad 38 has short bristles or felt-like material 40 on its bottom side for spreading of the paint or stain.

In operation, the operator pushes the plunger in all the way. Then he places an uptake stem into the uptake port 34 and lowers the stem into a paint container. After which the operator pulls the plunger 28 up and out of the reservoir 32 drawing paint into the stain stick 26. Thereafter, the operator pushes the plunger 28 inward into the reservoir 32 which displaces paint out on to the bristles 40 which is moved over the deck 12 to spread the paint.

The stain stick 26 works well for flat deck surfaces but does not work well for tight vertical surfaces as in joints 16, 18, 20, 22. U.S. Pat. No. 4,742,597 is a paint roller that addresses groves in siding. This roller is of very limited use as it would not work well on deck joint vertical surfaces and would unevenly loads up on paint when dipped and rolled in a paint roller pan. U.S. Pat. Nos. 7,192,210 and 7,325,900 are both for a deck stain applicator with two sets of permanently offset stiff bristles for coating deck gaps or vertical deck surfaces. Disadvantageously, this applicator requires the bristles to always be in a deck joint or gap for the applicator to be operational. If the deck boards are wide or tight together with no joints, this applicator will not work at all.

There is a need for a stain stick with a pad structure that will coat decks with tight or no joints as well as decks with small to large joints without any modifications.

SUMMARY OF THE INVENTION

A paint/stain stick pad, for use with a paint/stain reservoir handle and dispensing plunger for coating deck boards with opposing side edges having joints therebetween, has a platform having a top and a bottom. The top has a pivotal connection to the handle and a paint/stain inlet in flow communication with the paint/stain in the reservoir handle. The bottom has a paint/stain dispensing and spreading surface in flow communication with the paint/stain inlet for evenly dispensing the paint/stain along the dispensing surface onto the boards. A central cut out is provided in the platform into which a stain/paint applicator is mounted in a floating arrangement within the cut out and biased downwardly as to dispense paint/stain onto the opposing board edges in the joints.

A principal object and advantage of the present stain stick pad is the biased floating stain or paint applicator is biased downwardly but floating within the cut out as to ready allow the stain pad to randomly coat deck boards with or without joints of varying widths.

Another principal object and advantage of the present stain stick pad is that the floating, biased downwardly paint applicator may be temporarily perched up out of cut out in the platform when there are no joints to be coated.

Another principal object and advantage of the present stain stick pad is that the stain pad applicator is tapered to an apex as to fit within small joints or large joints while coating the boards' vertical side edges.

Another principal object and advantage of the present stain stick pad is that the applicator may take the shape of a tapered roller with an apex or block-like pad with a tapered side having an apex for flexibly fitting within small or large joints while coating the boards' vertical side edges.

Another principal object and advantage of the present stain stick pad is that applicator is readily replaceable on the pad platform with another new applicator should the first applicator become worn.

DETAILED SPECIFICATION

Figure 1:
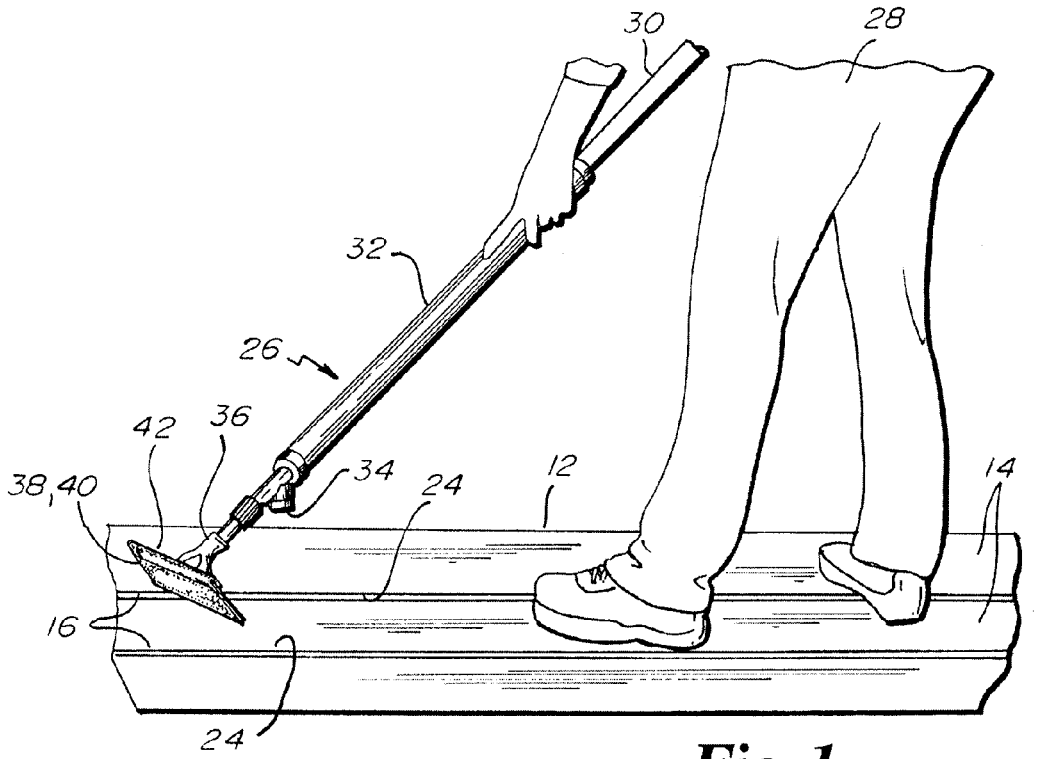
Fig. 1 (PRIOR ART)
FIG. 1 is a prior art view of the known paint stick permitting the operator to stand while only coating a deck top surface.
Figure 2:
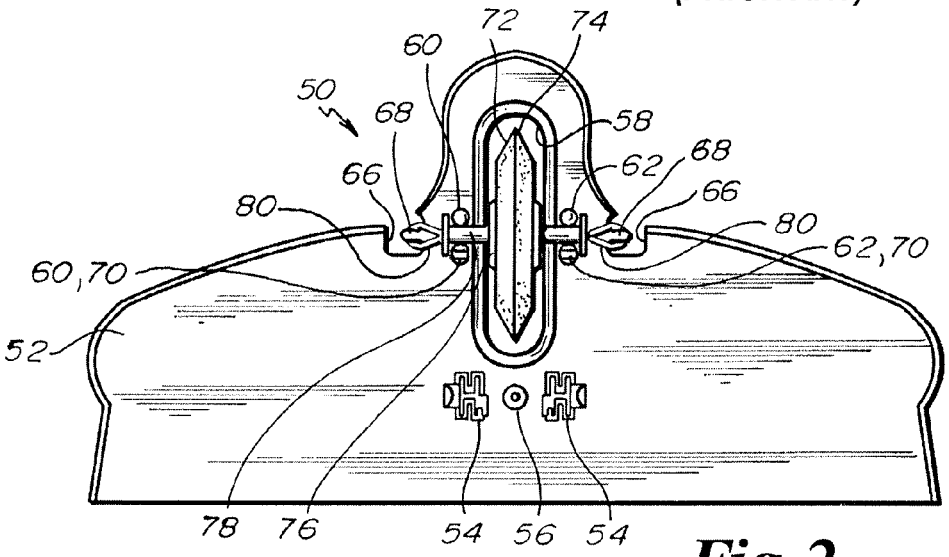
FIG. 2 is top plan view of the stain stick pad of the present invention with a roller applicator without the plunger/reservoir handle.

Referring generally to FIGS. 2-11, the paint/stain stick pad 50 with joint roller applicator 72 of the present invention may be understood. The pad 50 has a platform 52 with a top and bottom. On the top of platform 52 are stick mounting ears 54 for the stick gimbal joint 36. A stain/paint inlet 56 is also provided in flow communication with reservoir 32. The platform 52 has an applicator oval-shaped cut out 58 about which are opposing adjacent vertical dowels, pylons or posts 60,62 forming opposing applicator slots 64 therebetween. Also in the top of the platform 52 are located binder cut outs 66 with nubs 68. The tops of two opposing posts are formed with a depression thereby forming perches 70.

Roller applicator 72 is suitably made of open-celled foam or polyurethane. Apex 74 is outwardly formed on roller 72 as to permit at least a portion of the roller 72 to fit into deck joints 20 or 22 (small or large). Centrally located in the roller 72 is a support hub 76 through which is located an axel or copper tube 78 upon which the roller 72 and hub 76 freely rotate. A rubber band or binder 80 suitable passes through the axel 78 and each end is secured to the nubs 68 to bias the roller 72 downwardly into the cut out 58. The bottom of platform 52 has bristles or felt 82 which assists the in spreading of the coating on the deck 12. A bladder with a slit (not shown) is between the platform 52 and the bristles 82 to disburse the paint or stain onto the bristles 82 and roller 72 which is in flow communication with the platform inlet 96 and the reservoir 32.

Figure 3:
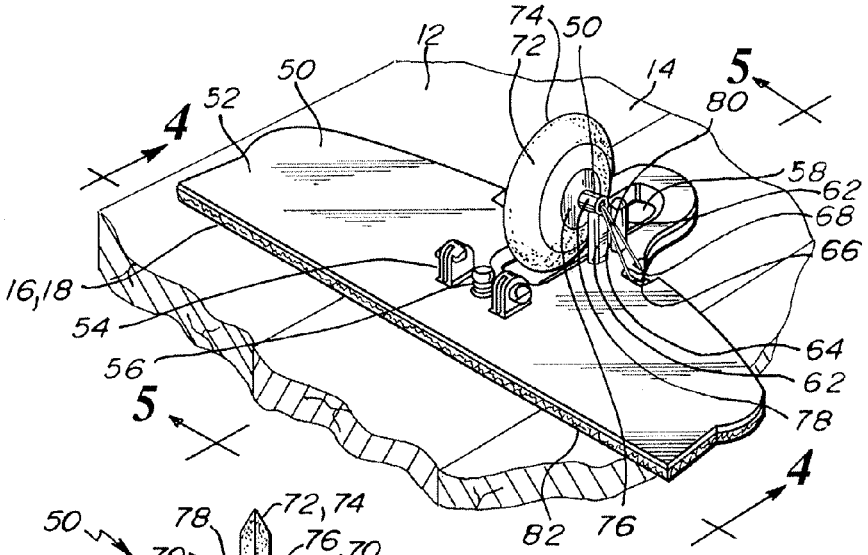
FIG. 3 is perspective view of the stain stick pad of the present invention without the plunger/reservoir handle on a deck with tight or no joints.
Figure 4:
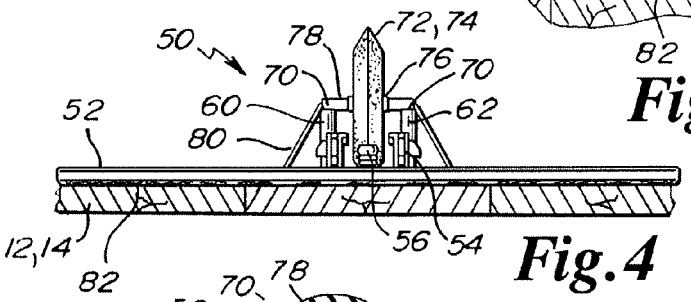
FIG. 4 is rear elevational view of the stain stick pad of the present invention without the plunger/reservoir handle on a deck in cross section with tight or no joints taken along lines 4-4 of FIG. 3.
Figure 5:
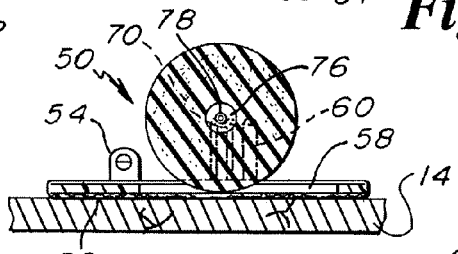
FIG. 5 is side elevational cross sectional view of the stain stick pad of the present invention without the plunger/reservoir handle on a deck with tight or no joints taken along lines 5-5 of FIG. 3.

Referring to FIGS. 3-5, the roller applicator 72 has its axel 78 is lifted onto perch 70 so that the applicator is totally out of the way when painting or staining a deck 12 that has no or tight joints 16, 18. The stain stick pad 50 simply glides over and coats all surfaces of the deck 12 just as easily as the prior stain stick pad 26.

Figure 6:
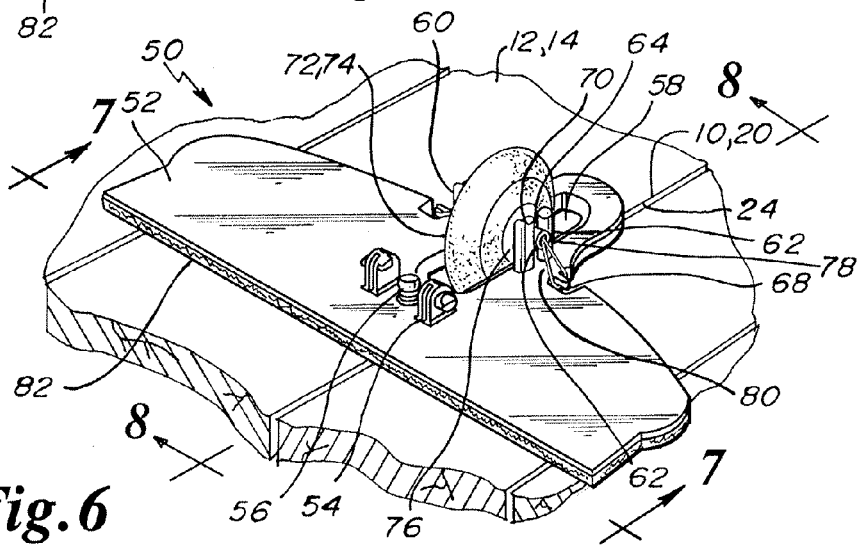
FIG. 6 is perspective view of the stain stick pad of the present invention without the plunger/reservoir handle on a deck with small joints.
Figure 7:
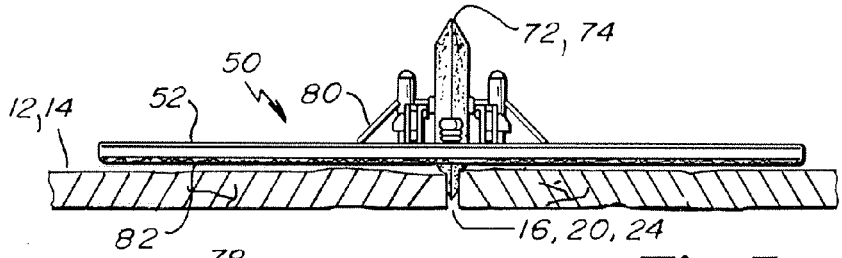
FIG. 7 is rear elevational view of the stain stick pad of the present invention without the plunger/reservoir handle on a deck in cross section with small joints taken along lines 7-7 of FIG. 6.
Figure 8:
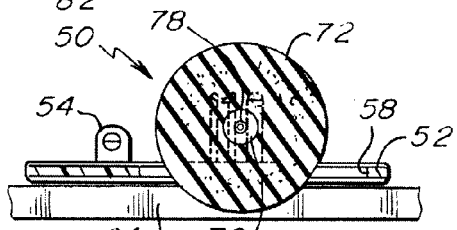
FIG. 8 is side elevational cross sectional view of the stain stick pad of the present invention without the plunger/reservoir handle on a deck with small joints taken along lines 8-8 of FIG. 6.

Referring to FIGS. 6-8, the deck 12 has narrow or small joints 16, 20. The roller applicator 72 is not perched but rather free floating in slots 64 and biased downwardly into cut out 58. The apex 74 of roller applicator 50 just fits into joints 16, 20 to coat the board side edges 24 while the bristles 82 coat the rest of deck 12.

Figure 9:
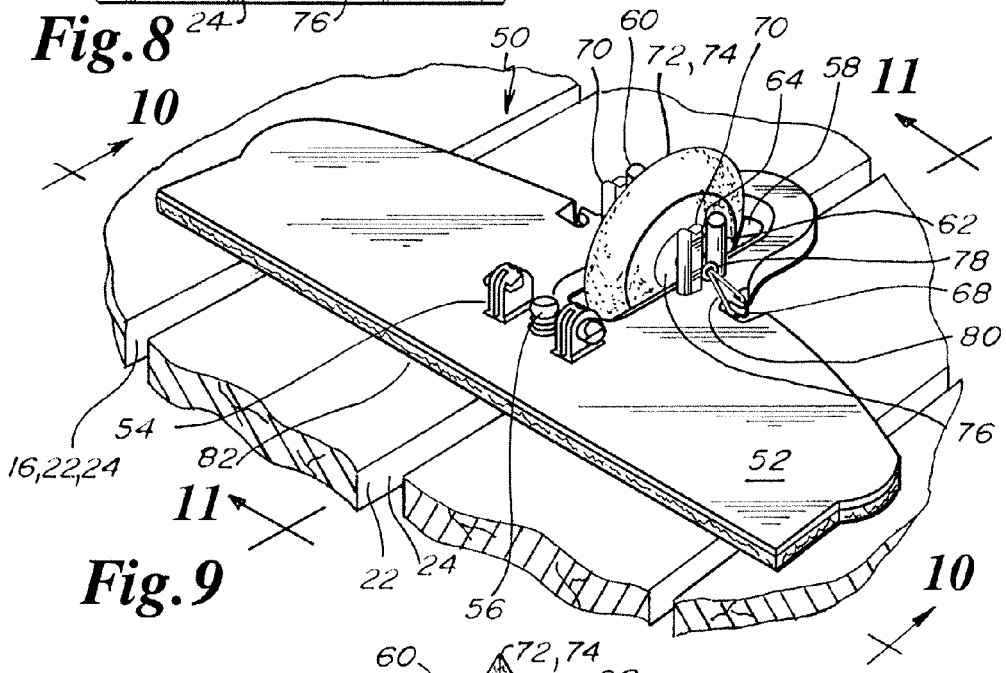
FIG. 9 is perspective view of the stain stick pad of the present invention without the plunger/reservoir handle on a deck with large joints.
Figure 10:
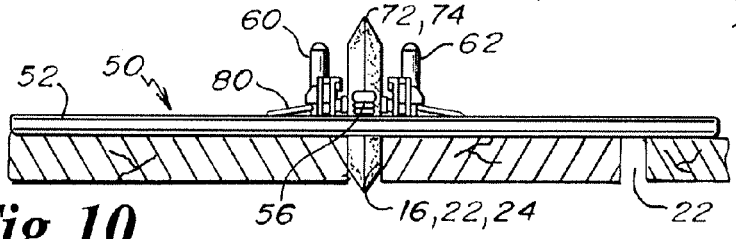
FIG. 10 is rear elevational view of the stain stick pad of the present invention without the plunger/reservoir handle on a deck in cross section with large joints taken along lines 10-10 of FIG. 9.
Figure 11:
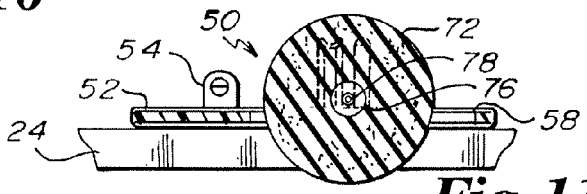
FIG. 11 is side elevational view of the stain stick pad of the present invention without the plunger/reservoir handle on a deck in cross section with large joints taken along lines 11-11 of FIG. 9.

Referring to FIGS. 9-11, the deck 12 has large joints 16, 22. The roller applicator 72 is not perched but rather free floating and biased downwardly into cut out 58. The apex 74 and sides of roller applicator 50 fit into joints 16, 22 to coat the board side edges 24 while the bristles 82 coat the rest of deck 12.

Referring to FIGS. 12-20, a second embodiment 90 of the paint/stain stick pad may be appreciated. Pad 90 has a top platform 92 with top and bottom. On the top of platform 92 are located stick mounting ears 94 for the stick gimbal joint 36. A stain/paint inlet 96 is also provided in flow communication with reservoir 32. The platform 92 has an applicator oval-shaped cut out 98 about which are opposing adjacent vertical dowels, pylons or posts 100, 101 forming opposing applicator slots 102 therebetween. Also in the top of the platform 92 are located binder cut outs 104 with nubs 106. The tops of two opposing posts 100, 101 are formed with a depression forming perches 108.

Pad applicator 110 is suitably made of open-celled foam or polyurethane. Apex 112 is downwardly formed on pad 110 as to permit at least a portion of the apex 112 of the pad applicator 110 to fit into deck joints 20 or 22 (small or large). Centrally located in the pad 110 is a support hub 114 through which are located an axels or copper tubes 116, 117 upon which the pad 110 and hub 114 freely floats upwardly and downwardly resisting any wobbling in slots 102. A rubber band or binder 118 suitable passes through the axel 117 and each end is secured to the nubs 106 to bias the pad 110 downwardly into the cut out 104. The bottom of platform 92 has bristles or felt 120 which assists in the spread of the coating on the deck 12. A bladder with a slit (not shown) is between the platform 92 and the bristles 120 to disburse the paint or stain onto the bristles 120 and pad 110 which is in flow communication with the platform inlet 96 and the reservoir 32.

Figure 12:
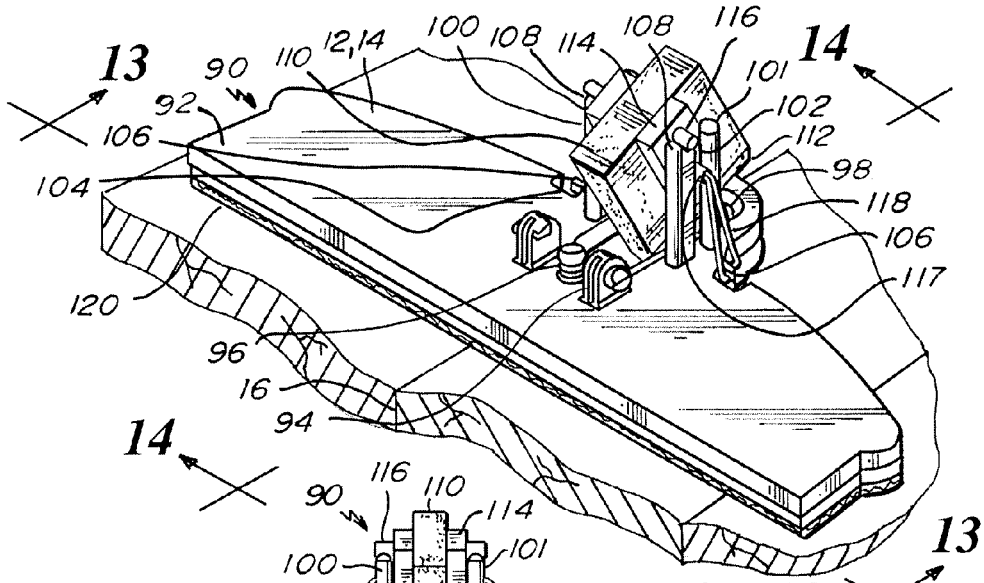
FIG. 12 is perspective view of a second embodiment of the stain stick pad of the present invention with a block pad applicator without the plunger/reservoir handle on a deck with tight or no joints.
Figure 13:
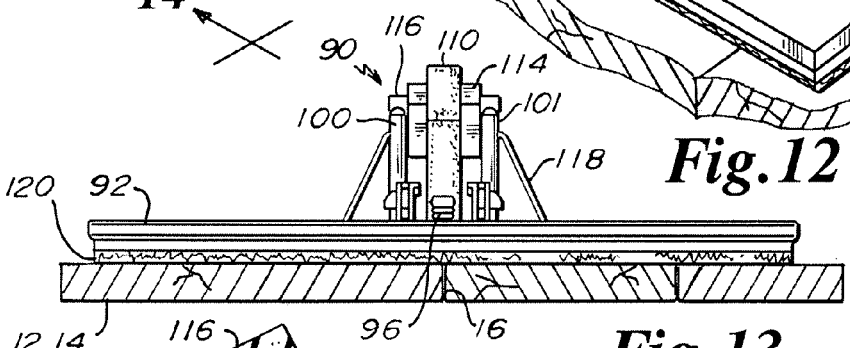
FIG. 13 is rear elevational view of the stain stick pad of the present invention without the plunger/reservoir handle on a deck in cross section with tight or no joints taken along lines 13-13 of FIG. 12.
Figure 14:
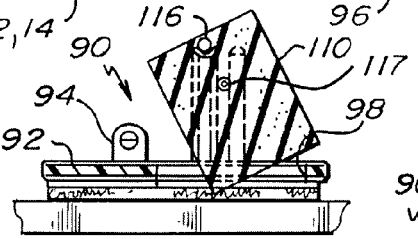
FIG. 14 is side elevational view of the stain stick pad of the present invention without the plunger/reservoir handle on a deck with tight joints taken along lines 14-14 of FIG. 12.

Referring to FIGS. 12-14, the pad applicator 110 has its axel 116 lifted onto perch 108 so that the applicator 110 is totally out of the way when painting or staining a deck 12 that has no or tight joints 16, 18. The stain stick pad 90 simply glides over and coats all surfaces of the deck 12 just as easily as the prior stain stick pad 26.

Figure 15:
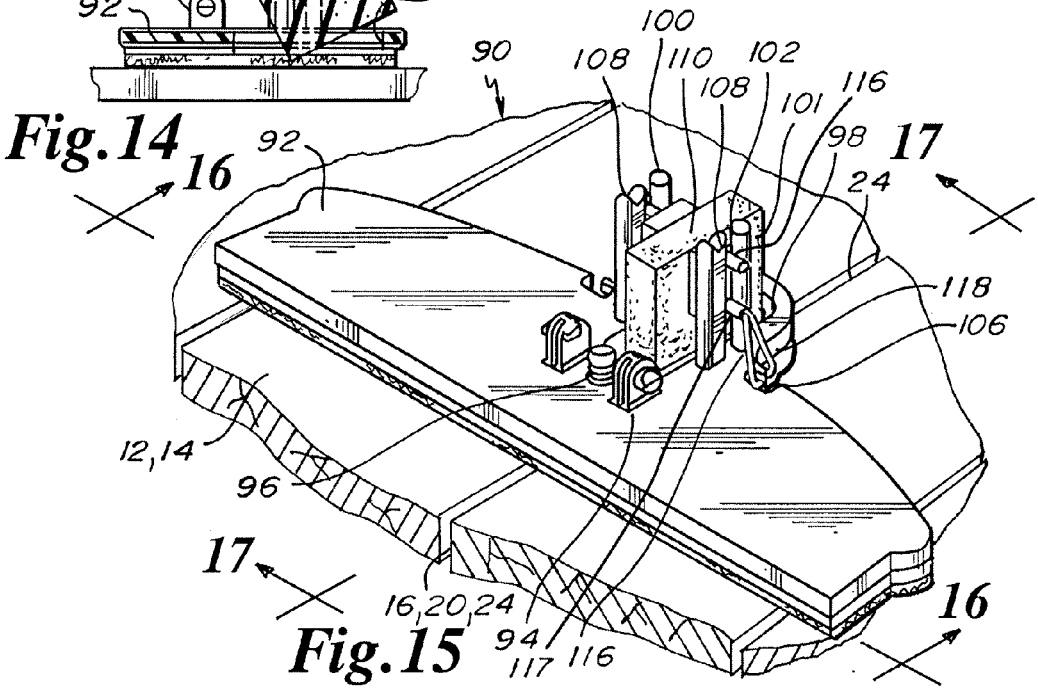
FIG. 15 is perspective view of the stain stick pad of the present invention with a block pad applicator without the plunger/reservoir handle on a deck with small joints.
Figure 16:
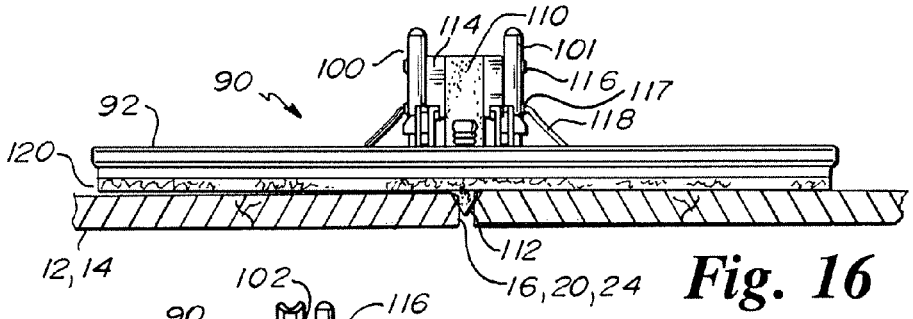
FIG. 16 is rear elevational view of the stain stick pad of the present invention without the plunger/reservoir handle on a deck in cross section with small joints taken along lines 16-16 of FIG. 15.
Figure 17:
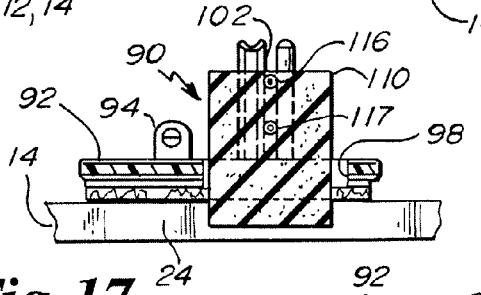
FIG. 17 is side elevational cross sectional view of the stain stick pad of the present invention without the plunger/reservoir handle on a deck with small joints taken along lines 17-17 of FIG. 15.

Referring to FIGS. 15-17, the deck 12 has narrow or small joints 16, 20. The pad applicator 110 is not perched but rather free floating and biased downwardly into cut out 98. The apex 112 of pad applicator 110 just fits into joints 16, 20 to coat the board side edges 24 while the bristles 120 coat the rest of deck 12.

Figure 18:
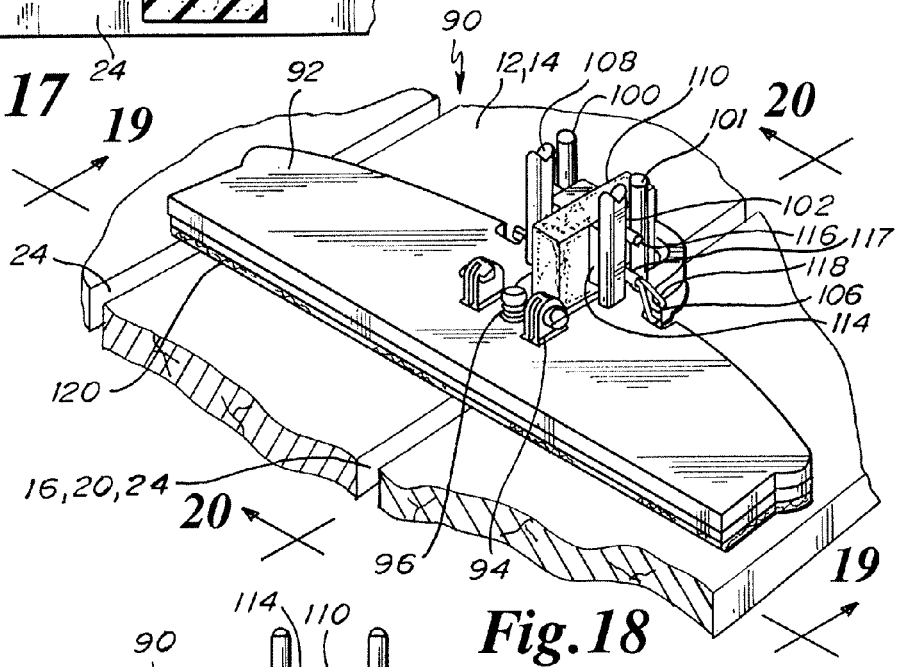
FIG. 18 is perspective view of the stain stick pad of the present invention with a block pad applicator without the plunger/reservoir handle on a deck with large joints.
Figure 19:
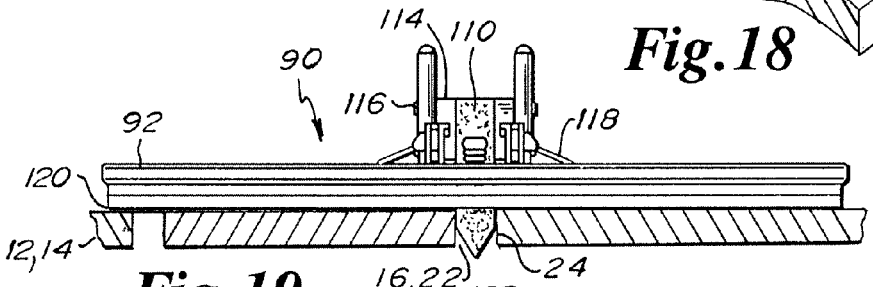
FIG. 19 is rear elevational view of the stain stick pad of the present invention without the plunger/reservoir handle on a deck in cross section with large joints taken along lines 19-19 of FIG. 18.
Figure 20:
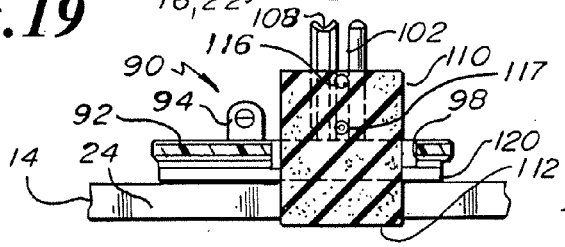
FIG. 20 is side elevational cross sectional view of the stain stick pad of the present invention without the plunger/reservoir handle on a deck with large joints taken along lines 20-20 of FIG. 18.

Referring to FIGS. 18-20, the deck 12 has large joints 16, 22. The pad applicator 110 is not perched but rather free floating and biased downwardly into cut out 98. The apex 112 and sides of pad applicator 110 fit into joints 16, 22 to coat the board side edges 24 while the bristles 120 coat the rest of deck 12.

Referring to FIGS. 21-26, a third embodiment 126 of paint/stain stick pad with joint roller applicator 146 of the present invention may be understood. The pad 126 has a platform 128 with a top and bottom. On the top of platform 128 are stick mounting ears 130 for the stick gimbal joint 36. A stain/paint inlet 132 is also provided in flow communication with reservoir 32. The platform 128 has an applicator oval-shaped cut out 134. Also the platform has binder ears 136 and roller support arm eyelets 138.

A roller support arm 139 is rotatably mounted in eyelets 138. The support arm 139 has a left portion 140, a right portion 144 and an axel portion 144. A roller applicator 146 with an apex 147 has centrally mounted hub 148 through which axel portion 144 of roller support arm 139 passes as to allow roller applicator 146 to freely rotate. Binders 150 are suitably wrapped around the left and right portion 140,142 and there from are connected to binder ears or nubs 136 as to bias the roller applicator downwardly into cut out 134. The bottom of platform 128 has bristles or felt 152 which assists in spread of the coating on the deck 12. A bladder with a slit (not shown) is between the platform 128 and the bristles 152 and roller 146 to disburse the paint or stain onto the bristles 152 which is in flow communication with the platform inlet 132 and the reservoir 32. Again, Roller applicator 146 is suitably made of open-celled foam or polyurethane. Apex 147 is outwardly formed on roller 146 as to permit at least a portion of the roller 146 to fit into deck joints 20 or 22 (small or large).

Figure 21:
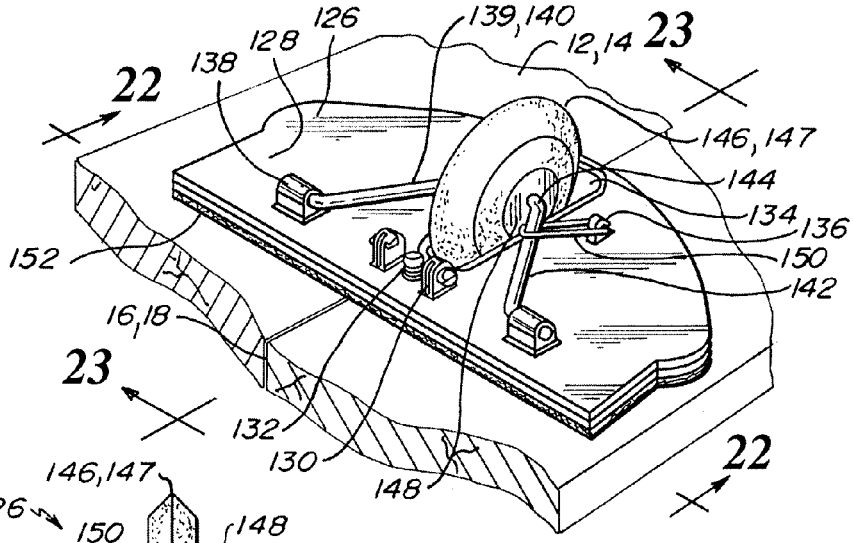
FIG. 21 is perspective view of a third embodiment of the stain stick pad of the present invention with a roller pad applicator without the plunger/reservoir handle on a deck with tight or no joints.
Figure 22:
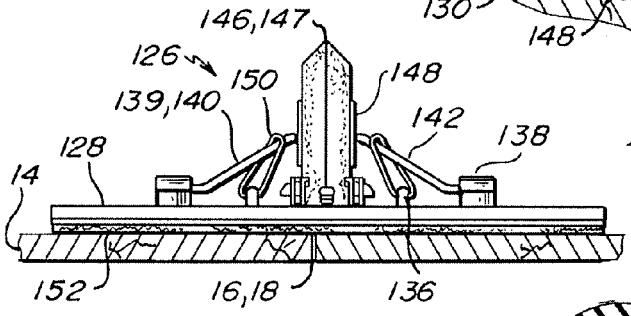
FIG. 22 is rear elevational view of the stain stick pad of the present invention without the plunger/reservoir handle on a deck in cross section with tight or no joints taken along lines 22-22 of FIG. 21.
Figure 23:
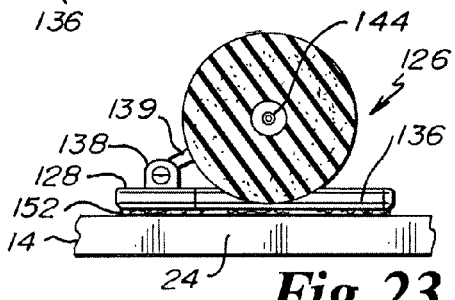
FIG. 23 is side elevational cross sectional view of the stain stick pad of the present invention without the plunger/reservoir handle on a deck with tight or no joints taken along lines 23-23 of FIG. 21.

Referring to FIGS. 21-23, the deck 12 has no or tight joints 16, 18. The roller applicator 146 is not perched but rather free floating and biased downwardly into cut out 134. As the operator coats the deck 12, the roller pad 146 simply is held out of the cut out 134 as deck 12 has no joints with side edges 24 to coat.

Figure 24:
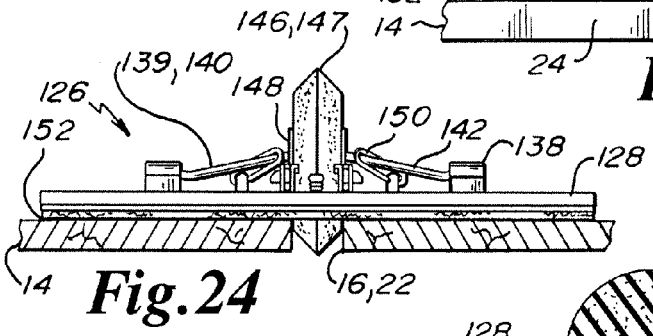
FIG. 24 is rear elevational view of the stain stick pad of the present invention without the plunger/reservoir handle on a deck in cross section with large joints similar to FIG. 22.
Figure 25:
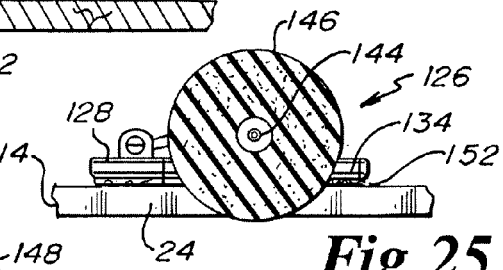
FIG. 25 is side elevational cross sectional view of the stain stick pad of the present invention in cross section without the plunger/reservoir handle on a deck with large joints similar to FIG. 23.
Figure 26:
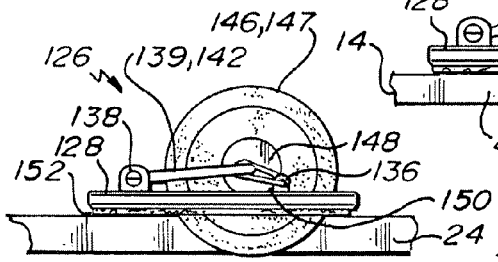
FIG. 26 is another side elevational view of the stain stick pad of the present invention without the plunger/reservoir handle on a deck with large joints similar to FIG. 24.

Referring to FIGS. 24-26, the apex 74 of roller applicator 50 fits into joints 16, 20 or 22 to coat the board side edges 24 while the bristles 82 coat the rest of deck 12.

Figure 27:
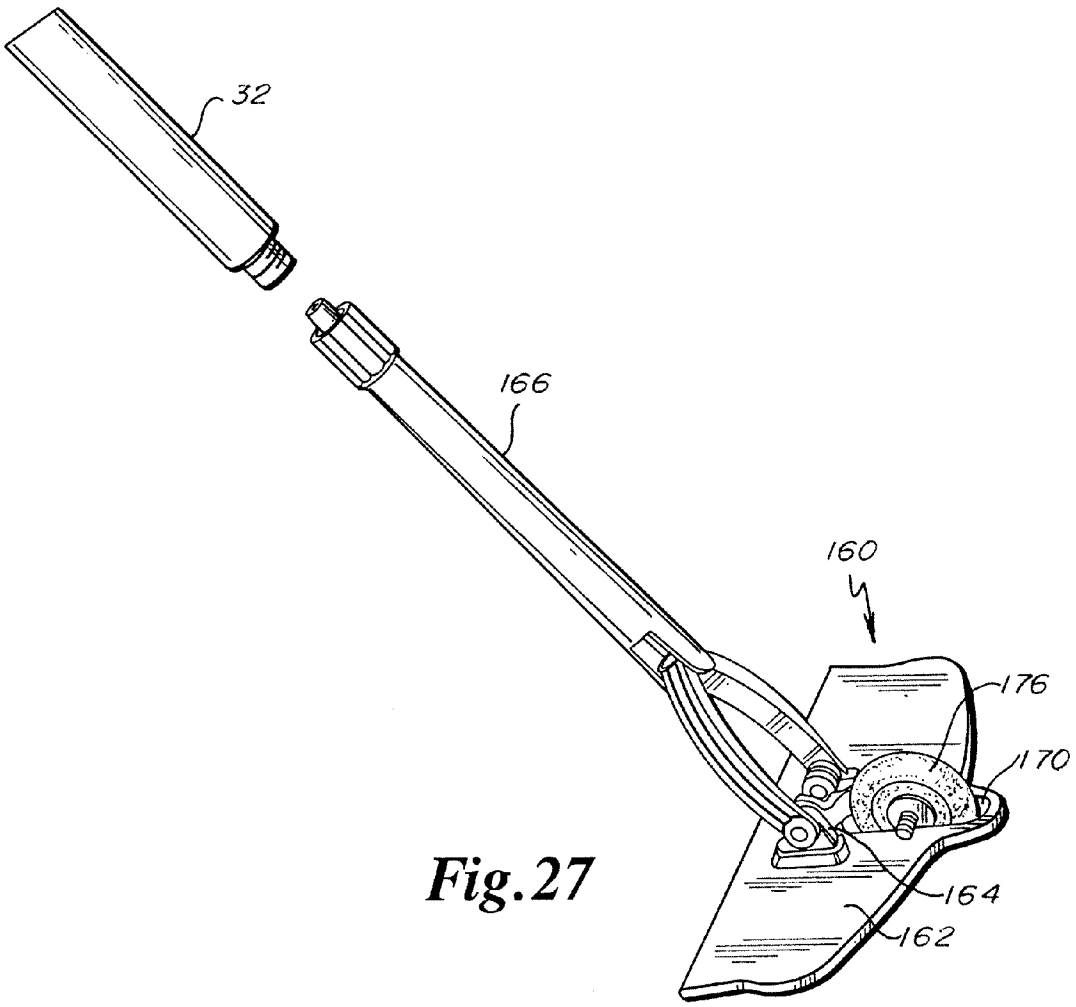
FIG. 27 is a perspective view of a third embodiment of the stain stick pad of the present invention with a roller pad applicator with a detached handle.
Figure 28:
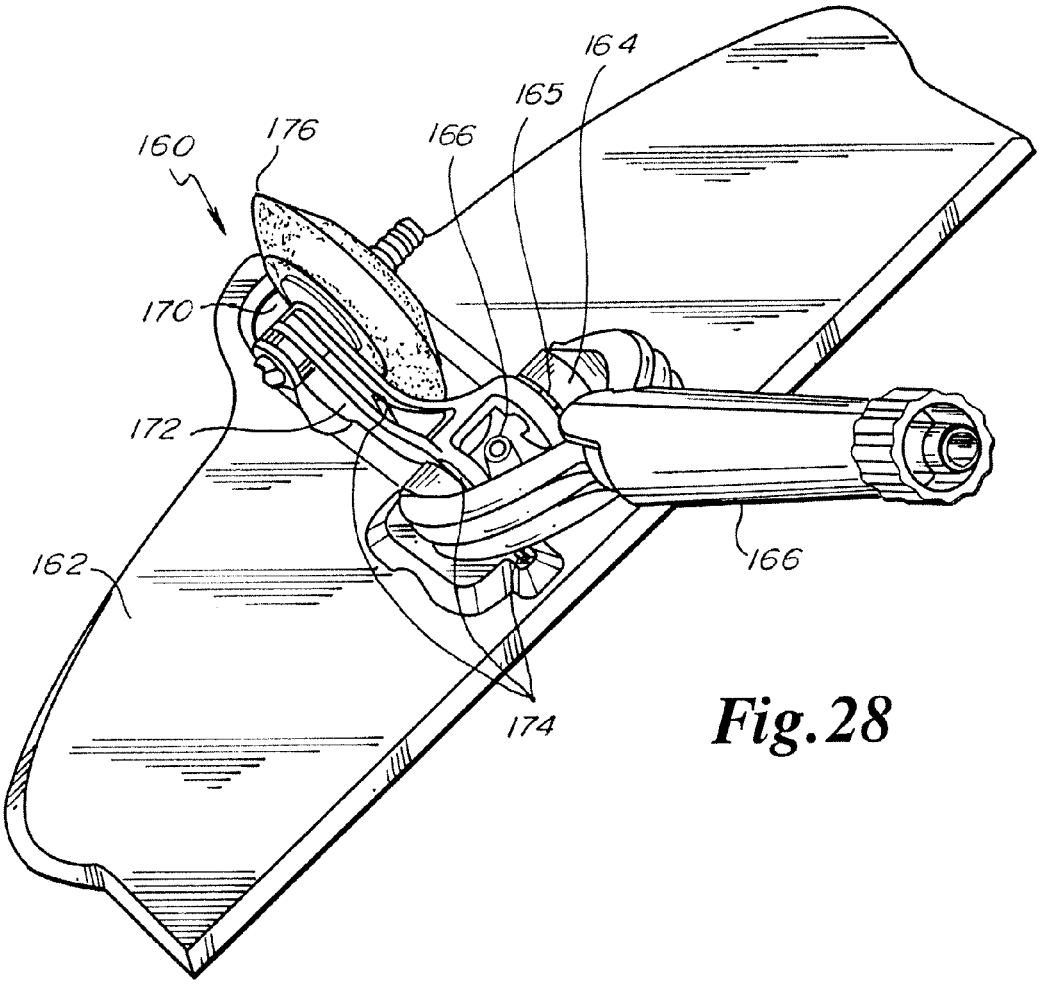
FIG. 28 is a top plan view of the stain stick pad of FIG. 27.

Referring to FIGS. 27 and 28, a fourth embodiment 160 of the paint/stain stick pad with forward joint roller applicator 176 of the present invention may be understood. The pad 160 has a platform 162 with a top and bottom. On the top of platform 162 are stick mounting ears 164 with pins 165 for the short handle 166 joint. A stain/paint inlet 168 may also be provided in flow communication with reservoir 32. The platform 162 has an applicator cut out 170. A roller applicator support arm 172, which supports roller applicator 176, is mounted concentric with the stick mount ears 164 and pins 165. A tension spring forces the arm 172 and roller applicator 176 downwardly into roller cut out 170.

This paint/stain stick pad 160 may be used with or without the plunger 30/reservoir 32 handle. The operator may simple grip the short handle 166 and dip the pad 160 directly into a paint tray and then simply apply the coating.

Figure 29:
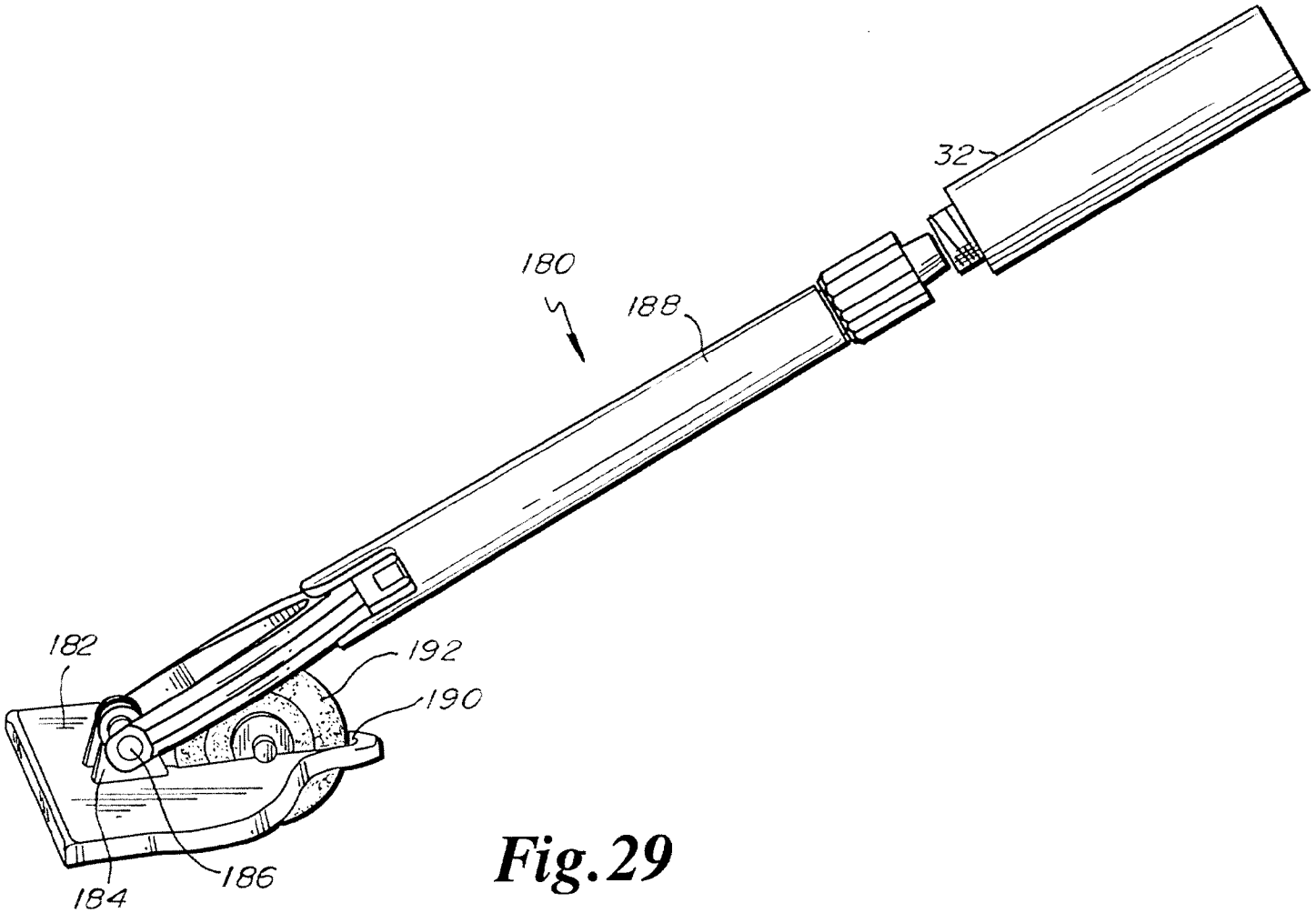
FIG. 29 is a perspective view of a fourth embodiment of the stain stick pad of the present invention with a roller pad applicator with a detached handle.

Referring to FIG. 29, a fifth embodiment 180 of the paint/stain stick pad with rearward joint roller applicator 192 of the present invention may be understood. The pad 180 has a platform 182 with a top and bottom. On the top of platform 182 are stick mounting ears 184 with pins 186 for the short handle 188 joint. A stain/paint inlet may also be provided in flow communication with reservoir 32 when used. The platform 182 has an applicator cut out 190. A roller applicator support arm, which supports rearward roller applicator 192, is mounted concentric with the stick mount ears 184 and pins 186. A tension spring forces the arm and roller applicator 192 downwardly into roller cut out 190.

This paint/stain stick pad 180 may be used with or without the plunger 30/reservoir 32 handle. The operator may simple grip the short handle 188 and dip the pad 180 directly into a paint tray and then simply apply the coating. Alternatively, all paint/stain stick pad embodiments 50, 90, 126, 160 and 180 could be used with any of a variety of stain/paint feed mechanisms, including but not limited to pumps, gravity feeds or the like represented as numeral 32 in the FIGS.

The above specification and accompanying FIGS are for illustrative purposes which the true scope of this invention may be understood by the following claims.

What is claimed:

1. A paint/stain stick pad for use with a paint/stain reservoir handle and dispensing plunger for coating deck boards with opposing side edges having joints therebetween, the pad comprising:

a) a platform having a top and a bottom, the top having a pivotal connection to the handle, a paint/stain inlet in flow communication with the paint/stain in the reservoir handle, the bottom having a paint/stain dispensing surface in flow communication with the paint/stain inlet for evenly dispensing the paint/stain along the dispensing surface onto the boards;

b) a central cut out in the platform and a single stain/paint applicator with an apex floating within the cut out and biased downwardly as to dispense paint/stain onto the opposing board edges in the joints; and c) a perch above the cut out for parking the applicator above and out of the cut out.

2. The pad of claim 1, further comprising two opposing vertical slot structures on each side of the cut out as to confine the applicator to vertical movement as the applicator floats within the cut out.

3. The pad of claim 2, wherein the opposing slot structures are comprised of two adjacent vertical posts on each side of the cut out as to confine the applicator to vertical movement as the applicator floats within the cut out.

4. The pad of claim 3, further comprising a perch on two vertical opposing posts on each side of the cut out for parking the applicator out of the cut out.

5. The pad of claim 1, further comprising resilient contractible bands connected to the platform and the applicator biasing the applicator downwardly into the cut out.

6. The pad of claim 1, wherein the applicator is a roller with an apex rotatable within the cut out as to coat the opposing board edges.

7. The pad of claim 1, wherein the applicator is a block pad with a downward apex.

8. The pad of claim 7, wherein the pad applicator is supported on a hub with an axel therethrough and two adjacent vertical posts on each side of the cut out as to confine the axel to vertical movement as the pad applicator floats within the cut out.

9. The pad of claim 1 further comprising, a biased downwardly, rotatable applicator support arm connected to the applicator as to confine the applicator to vertical movement as the pad applicator floats above and within the cut out.

10. The pad of claim 9, wherein the cut out is forward of the pivotal connection.

11. The pad of claim 9, wherein the cut out is rearward of the pivotal connection.

12. The pad of claim 11, wherein the stain/paint applicator is a roller with an apex for fitting within the board joints.

13. A paint/stain stick pad for use with a paint/stain reservoir handle and dispensing plunger for coating deck boards with opposing side edges having joints therebetween, the pad comprising:

a) a platform having a top and a bottom, the top having a pivotal connection to the handle, a paint/stain inlet in flow communication with the paint/stain in the reservoir handle, the bottom having a paint/stain dispensing surface in flow communication with the paint/stain inlet for evenly dispensing the paint/stain along the dispensing surface onto the boards;

b) a central cut out in the platform and a stain/paint roller applicator with an apex floating within the cut out and biased downwardly as to dispense paint/stain onto the opposing board edges in the joints, the roller applicator is supported on a hub with an axel therethrough;

c) opposing vertical slot structures on each side of the cut out as to confine the axel to vertical movement as the pad applicator floats within the cut out; and d) a perch above the cut out for parking the roller applicator above and out of the cut out.

14. The pad of claim 13, wherein the opposing slot structures are comprised of two adjacent vertical posts on each side of the cut out as to confine the applicator to vertical movement as the applicator floats within the cut out.

15. The pad of claim 13, wherein the perch is on two vertical opposing posts on each side of the cut out for parking the applicator out of the cut out.

16. The pad of claim 13, further comprising resilient contractible bands connected to the platform and the applicator biasing the applicator downwardly into the cut out.

17. A paint/stain stick pad for coating deck boards with opposing side edges having joints therebetween, the pad comprising:

a) a platform having a top and a bottom, the top having a pivotal connection to a handle, the bottom having a paint/stain dispensing surface for receiving and evenly dispensing the paint/stain along the dispensing surface onto the boards;

b) a central cut out in the platform;

c) a single stain/paint applicator with an apex supported on a hub with an axel therethrough; and d) a biased downwardly, rotatable applicator support arm connected to the axel as to confine the axel to vertical movement as the pad applicator floats above and within the cut out.

18. A paint/stain stick pad for use with a paint/stain reservoir handle and dispensing plunger for coating deck boards with opposing side edges having joints therebetween, the pad comprising:

e) a platform having a top and a bottom, the top having a pivotal connection to the handle, a paint/stain inlet in flow communication with the paint/stain in the reservoir handle, the bottom having a paint/stain dispensing surface in flow communication with the paint/stain inlet for evenly dispensing the paint/stain along the dispensing surface onto the boards; and b) a central cut out in the platform and a stain/paint roller applicator with an apex floating within the cut out and biased downwardly as to dispense paint/stain onto the opposing board edges in the joints, the roller applicator is supported on a hub with an axel therethrough, wherein the roller is supported on a hub with an axel therethrough and two adjacent vertical posts on each side of the cut out as to confine the axel to vertical movement as the roller applicator floats within the cut out.

* * * * *